US009746796B2

(12) United States Patent
Harada

(10) Patent No.: US 9,746,796 B2
(45) Date of Patent: Aug. 29, 2017

(54) IMAGE FORMING APPARATUS

(71) Applicant: Oki Data Corporation, Tokyo (JP)

(72) Inventor: Daisuke Harada, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/158,824

(22) Filed: May 19, 2016

(65) Prior Publication Data

US 2016/0378015 A1 Dec. 29, 2016

(30) Foreign Application Priority Data

Jun. 23, 2015 (JP) ..... 2015-125453

(51) Int. Cl.
*G03G 15/043* (2006.01)
*G03G 15/01* (2006.01)
*G03G 15/00* (2006.01)

(52) U.S. Cl.
CPC ..... *G03G 15/043* (2013.01); *G03G 15/011* (2013.01); *G03G 15/0189* (2013.01); *G03G 15/5058* (2013.01); *G03G 2215/0161* (2013.01)

(58) Field of Classification Search
CPC ..... G03G 15/043; G03G 15/5054; G03G 15/5058
See application file for complete search history.

(56) References Cited

U.S. PATENT DOCUMENTS 6,853,392 B2 * 2/2005 Maeda ..... G03G 15/0152 347/116
2004/0239747 A1 * 12/2004 Maeda ..... G03G 15/5058 347/116
2012/0148315 A1 * 6/2012 Nakashima ..... G03G 15/5054 399/301
2014/0029965 A1 * 1/2014 Shiobara ..... G03G 15/1605 399/49
2014/0146120 A1 * 5/2014 Miyadera ..... G03G 15/01 347/116

FOREIGN PATENT DOCUMENTS

JP 2014025962 A 2/2014

* cited by examiner

*Primary Examiner* — David M Gray
*Assistant Examiner* — Carla Therrien
(74) *Attorney, Agent, or Firm* — Panitch Schwarze Belisario & Nadel LLP

(57) ABSTRACT

An image forming apparatus includes: a first image forming unit for forming toner images on a first photosensitive body; a second image forming unit for forming toner images on a second photosensitive body; a first exposure unit for exposing the first photosensitive body; a second exposure unit for exposing the second photosensitive body; a transfer unit for transferring, onto an intermediate transfer belt, toner images for correction formed from the first image forming unit and the second image forming unit; a detection unit for detecting the toner images for correction; and a control unit for controlling an exposure cycle of the first exposure unit, wherein the control unit corrects the exposure cycle of the first exposure unit based on a detected consequence of the detection unit.

10 Claims, 6 Drawing Sheets

IMAGE FORMING APPARATUS

CROSS REFERENCE TO RELATED APPLICATIONS

This application claims priority benefits under 35 USC, section 119 on the basis of Japanese Patent Application No. 2015-125453, the disclosure of which is incorporated herein by reference.

BACKGROUND OF THE INVENTION

1. Field of the Invention

This invention relates to an image forming apparatus.

2. Description of Related Art

In conventional image forming apparatuses of so-called tandem type, toner images formed on a photosensitive drum in each image forming unit, or each image drum unit, are transferred onto a medium such as printing paper conveyed by a transfer belt or onto a transfer belt.

Speed irregularity, however, may occur due to contraction and expansion of a belt material structuring the transfer belt or due to deviations of frictional coefficient of drive rollers for driving the transfer belt, thereby resulting deviations with respect to the designed value of the speed of the transfer belt. Such speed deviations of the transfer belt may affect the conveyance speed of media, so that images printed on the medium may be suffered from contraction and expansion of images in a sub-scanning direction (see, e.g., Japanese Patent Application Publication (A1), No. 2014-025962).

SUMMARY OF THE INVENTION

It is therefore an object of the invention to provide an image forming apparatus capable of solving problems arising from conventional structures.

To solve the above problems, an image forming apparatus includes: a first image forming unit for forming toner images on a first photosensitive body; a second image forming unit for forming toner images on a second photosensitive body; a first exposure unit for exposing the first photosensitive body; a second exposure unit for exposing the second photosensitive body; a transfer unit for transferring, onto an intermediate transfer belt, toner images for correction formed from the first image forming unit and the second image forming unit; a detection unit for detecting the toner images for correction; and a control unit for controlling an exposure cycle of the first exposure unit, wherein the control unit corrects the exposure cycle of the first exposure unit based on a detected consequence of the detection unit.

According to the image forming apparatus of the invention, the problem that contraction and extension of images in the sub-scanning direction occurs can be solved.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF EMBODIMENTS

Selected embodiments of the present invention will now be explained with reference to the drawings. It will be apparent to those skilled in the art from this disclosure that the following descriptions of the embodiments of the invention are provided for illustration only and not for the purpose of limiting the invention as defined by the appended claims and their equivalents.

First Embodiment

Figure 1:
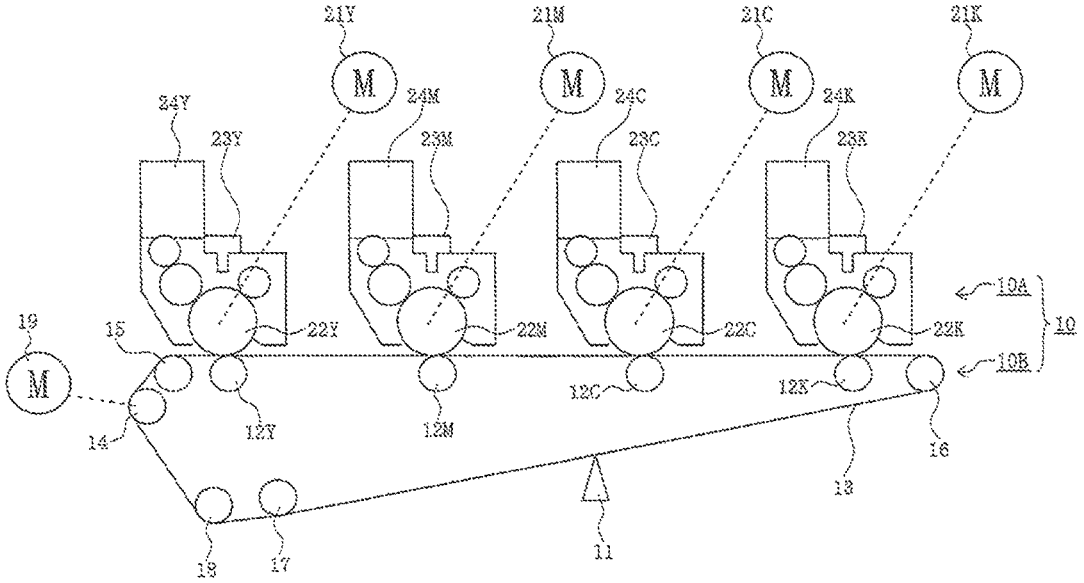
FIG. 1 is a schematic view showing an essential portion of an image forming apparatus according to a first embodiment of the invention.

FIG. 1 is a schematic view showing an essential portion of an image forming apparatus according to a first embodiment of the invention.

In FIG. 1, the image forming apparatus 10 is typically such as a printer, a facsimile machine, a photocopier, an MFP (multifunction peripheral) having functions of printer, facsimile machine, and photocopier, and can be any type of image forming apparatuses. In this embodiment, a multicolor photographic printer of tandem type is exemplified as the image forming apparatus 10.

As shown in FIG. 1, the image forming apparatus 10 has an image forming unit 10A and a transfer unit 10B. For the sake of brevity, details are omitted from the illustration except the image forming unit 10A and the transfer unit 10B.

The image forming unit 10A includes ID units 24Y, 24M, 24C, 24K as image forming members for forming toner images as images in respective colors, yellow, magenta, cyan, and black. It is to be noted that the letters Y, M, C, and K represent correspondences to the respective colors, yellow Y, magenta M, cyan C, and black K. The kinds and numbers of the colors are not limited to four colors, but can be three colors or less or five colors or more. Where the ID units 24Y, 24M, 24C, 24K are explained collectively, it is explained as the ID unit 24. If various members corresponding to respective colors are to be explained separately, the letters Y, M, C, and K corresponding to the respective colors are attached, whereas if various members are explained collectively, the letters Y, M, C, and K corresponding to the respective colors are not attached.

Each ID unit 24 includes, e.g., a photosensitive drum 22 serving as a photosensitive body, a charge roller charging the surface of the photosensitive drum 22, an LED head 23 serving as an exposure unit forming latent images upon selectively exposing the charged surface of the photosensitive drum 22 to the light, a developing roller developing the latent images by supplying toner as developing agents to the surface of the photosensitive drum 22 to form the toner images, and a toner supply roller for supplying toner to the developing roller. Each of the photosensitive drums 22 is rotated by a photosensitive drum drive motor 21 as a drive source.

The transfer unit 10B includes, e.g., a belt drive roller 14, driven rollers 15 to 17, a backup roller 18, and an intermediate transfer belt 13 serving as an intermediate transfer body tensioned around the peripheries of the belt drive roller 14, the driven rollers 15 to 17, and the backup roller 18. A primary transfer roller 12 is disposed at a position corresponding to the photosensitive drum 22 of the respective ID units 24 as to face the photosensitive drum 22 via the intermediate transfer belt 13. The belt drive roller 14 is driven to rotate by an intermediate transfer belt drive motor 19 as a drive source, and consequently, the intermediate transfer belt 13 is rotated.

A prescribed bias voltage is applied to each of the primary transfer rollers 12, thereby generating a prescribed voltage difference between each of the primary transfer rollers 12 and the photosensitive drum 22 facing to the roller. With the potential difference, the toner image formed on the surface of the photosensitive drum 22 is transferred onto the surface of the intermediate transfer belt 13. Multicolor images are therefore formed on the surface of the intermediate transfer belt 13 in overlapping the respective color toner images of yellow, magenta, cyan, and black.

A color shift sensor 11 is disposed near the surface of the intermediate transfer belt 13 corresponding to a midway portion of the driven rollers 16, 17, serving as a detection unit for detecting toner images on the surface of the intermediate transfer belt 13. The color shift sensor 11 detects positional shifts of color shift pattern images as toner images for correction of the respective colors transferred to the surface of the intermediate transfer belt 13, or namely color shifting of the toner images. A specific method for detecting the positional shifts, or color shifts, of the toner images is done in substantially the same way as known methods disclosed in, e.g., Japanese Patent Application Publication (A1), No. 2001-134041, the disclosure of which is incorporated herein by reference.

The image forming apparatus 10 further includes such as, e.g., a medium supply unit, a medium conveyance unit, and a fixing unit. The medium supply unit includes a paper tray or trays containing media such as, e.g., printing paper, and supplies the medium sheet by sheet. The medium conveyance unit includes a paper conveyance apparatus such as, e.g., a paper conveyance belt, and paper conveyance rollers, and conveys the medium fed from the medium supply unit to render the medium contact to the surface of the intermediate transfer belt 13 at the position of the backup roller 18. With this operation, the toner images formed on the intermediate transfer belt 13 are transferred to the surface of the medium. The fixing unit includes, e.g., a heating roller and a pressure roller and fixes the toner images to the medium in application of heat and pressure to the medium with the toner images transferred thereon.

Figure 2:
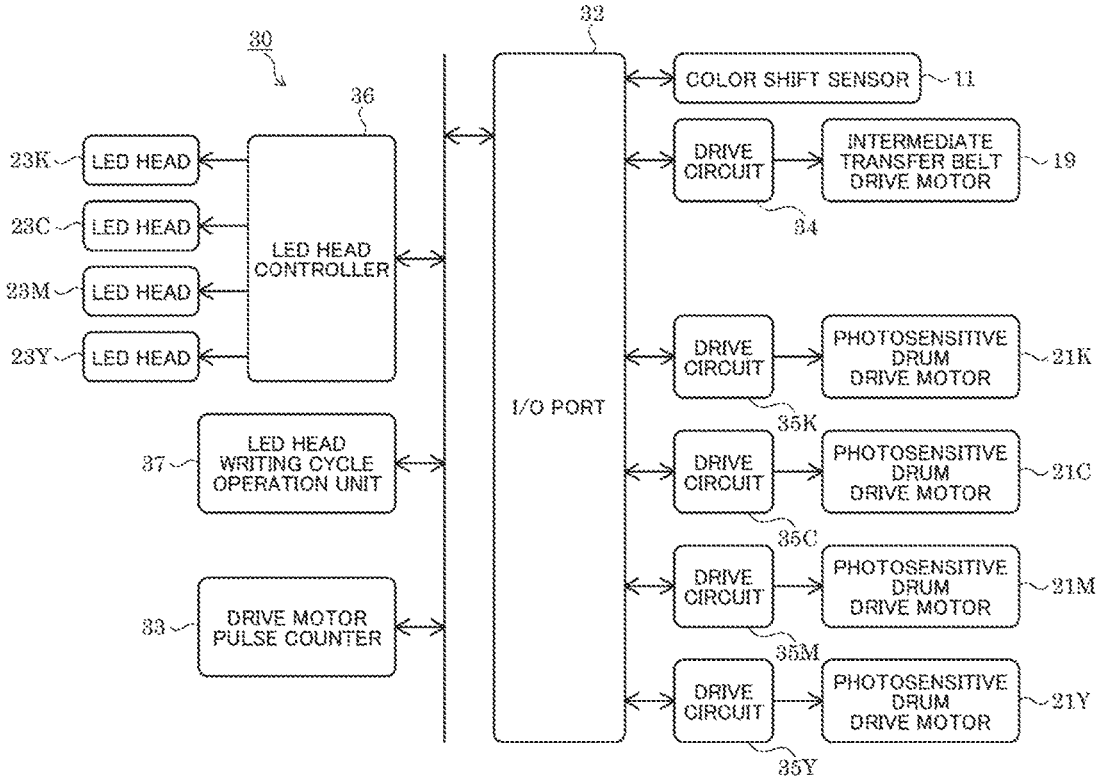
FIG. 2 is a block diagram showing a structure of a control unit of the image forming apparatus according to the first embodiment of the invention.

Next, a structure of a control unit 30 of the image forming apparatus 10 is described. FIG. 2 is a block diagram showing the structure of the control unit 30 of the image forming apparatus 10 according to the first embodiment of the invention.

In FIG. 2, the image forming apparatus 10 includes the control unit 30. The control unit 30 as shown in FIG. 2 includes an LED head controller 36, an LED head writing cycle operation unit 37, a drive motor pulse counter 33, an I/O port 32 as an input and output port, a drive circuit 34 of an intermediate transfer belt drive motor 19, and drive circuits 35Y, 35M, 35C, 35K of the photosensitive drum drive motors 21Y, 21M, 21C, 21K. As described above, if various members corresponding to respective colors are to be explained separately, the letters Y, M, C, and K corresponding to the respective colors are attached, whereas if various members are explained collectively, the letters Y, M, C, and K corresponding to the respective colors are not attached.

The LED head writing cycle operation unit 37 calculates exposure cycle (light emitting cycle) as writing cycle for each of the LED heads 23. The LED head controller 36 controls the exposure timing of the respective LED heads 23 based on the exposure cycle calculated from the LED head writing cycle operation unit 37. The drive motor pulse counter 33 counts the motor pulse signal as the input signal of the intermediate transfer belt drive motor 19 and the photosensitive drum drive motors 21.

The image forming apparatus according to the image forming apparatus 10, includes the ID units 24Y, 24M, 24C, 24K as image forming members for forming toner images onto the photosensitive drums 22Y, 22M, 22C,22K as the photosensitive bodies, the LED heads 23Y, 23M, 23C, 23K as the exposure units for exposing the photosensitive drums 22Y, 22M, 22C,22K, the transfer unit 10B transferring to the intermediate transfer belt the color shifting pattern image for correction formed with the ID units 24Y, 24M, 24C, 24K, the color shift sensor 11 serving as the detection unit detecting the color shifting pattern image, and the control unit 30 controlling the exposure cycle of the LED heads 23Y, 23M, 23C, 23K. The control unit 30 corrects the exposure cycle of the LED heads 23Y, 23M, 23C, 23K based on the detected results of the color shift sensor 11.

Next, the operation of the image forming apparatus 10 thus structured is described. The description herein is only for image's contraction and expansion in a sub-scanning direction, or namely, the conveyance direction (rotation direction) of the intermediate transfer belt 13, or in other words, the operation correcting the image contraction and expansion.

Figure 3:
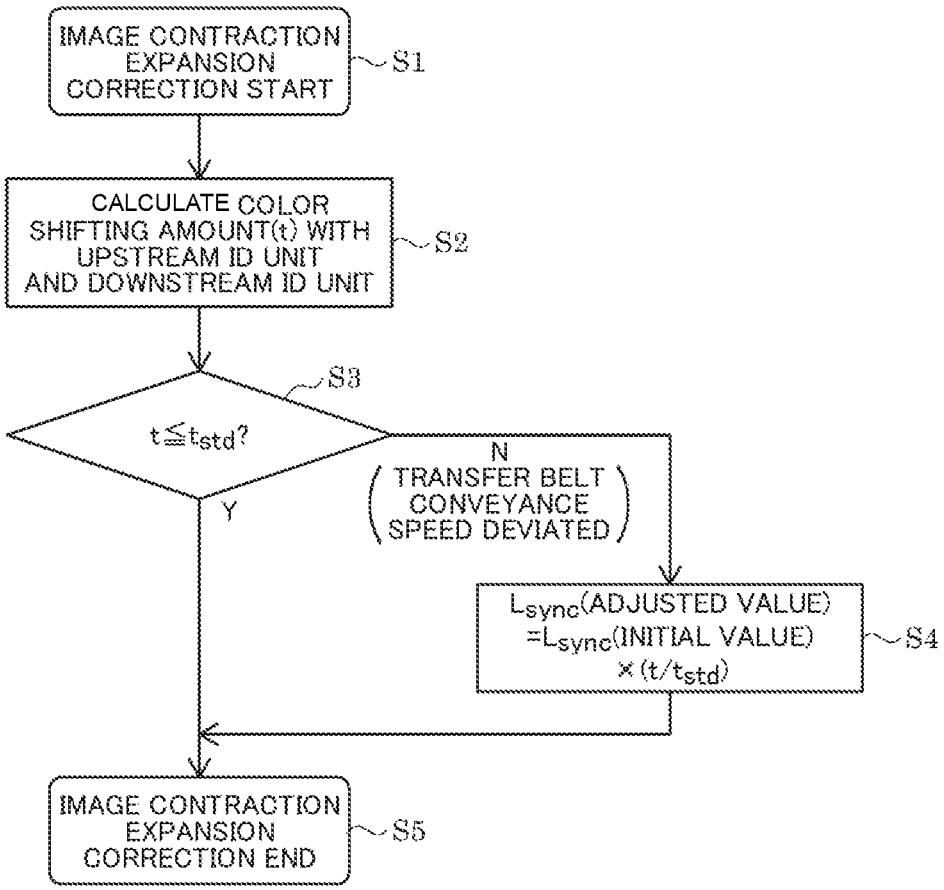
FIG. 3 is a flowchart showing operation of an image contraction and expansion control according to the first embodiment of the invention.

FIG. 3 is a flowchart showing operation of the image contraction and expansion correction in the first embodiment of the invention.

For color shift of the toner images, there are situations mainly caused by image contraction and expansion occurring due to speed (i.e., conveyance speed or rotation speed) deviations of the intermediate transfer belt 13, and situations mainly caused by positional shifts of the formation of the toner images at the ID units 24 occurring due to e.g., aging changes. In this embodiment, operation for correcting image contraction an expansion in a case where color shifting of the toner images occur mainly due to image contraction and expansion from speed deviations of the intermediate transfer belt 13, is described.

First, at Step S1, the image forming apparatus 10 begins control operation for correcting image contraction and expansion, that is, correction of image contraction and expansion. More specifically, the control unit 30 begins image contraction and expansion correction at a time, e.g., when executing an initial processing where the image forming apparatus 10 is powered on, and when finishing printing jobs of a prescribed number.

Subsequently, at Step S2, the image forming apparatus 10 calculates the color shifting amount (t) between an upstream ID unit 24 and a downstream ID unit 24 as a standard. More specifically, the control unit 30 calculates the color shifting amount (t) with the ID unit 24Y located on the most upstream side in the conveyance direction of the intermediate transfer belt 13 and with the ID unit 24K forming black toner images as the standard color located on the most downstream side in the conveyance direction of the intermediate transfer belt 13. The color shifting amount (t) is a shifting amount of the color shifting pattern images formed by the ID unit 24Y with respect to the color shifting pattern images formed by the ID unit 24K. For example, the control unit 30 makes the ID unit 24Y located on the most upstream side in the conveyance direction of the intermediate transfer belt 13 and the ID unit 24K forming black toner images as the standard color located on the most downstream side in the conveyance direction of the intermediate transfer belt 13 form a yellow pattern for color shifting detection and a black pattern for color shifting detection, thereby calculating the color shifting amount (t) relating to the conveyance direction of the intermediate transfer belt 13. The color shifting amount (t) is a parameter indicating the color shifting amount of the yellow pattern for color shifting detection with respect to the black pattern for color shifting detection where rendering the black pattern for color shilling detection set as the standard. Specific calculation methods of the color shifting amount (t) are disclosed in, e.g., Japanese Patent Application Publication (A1), No. 2001-134041, above-mentioned, and any duplicated description is omitted.

Subsequently, at Step S3, the image forming apparatus 10 compares the color shifting amount (t) calculated at Step S2 and a threshold value ($t_{std}$) for discriminating existence of color shifting. More specifically, the color shifting sensor 11 judges as to whether the color shifting amount (t) is equal to or less than the preset threshold value ($t_{std}$) for discriminating existence of color shifting, or namely $t \leq t_{std}$ or not.

If the color shifting amount (t) exceeds the preset threshold value ($t_{std}$) for discriminating existence of color shifting, the control unit 30 judges that the transfer belt conveyance speed is deviated, or namely, that there are some deviations of the conveyance speed of the intermediate transfer belt 13, and the processing moves to Step S4. If the color shifting amount (t) is equal to or less than the preset threshold value ($t_{std}$) for discriminating existence of color shifting, the control unit 30 judges as to whether there is no deviation of the conveyance speed of the intermediate transfer belt 13, and the processing goes to Step S5.

At Step S4, the image forming apparatus 10 adjusts the exposure cycle ($L_{sync}$) of the LED head 23. More specifically, the LED head controller 36 adjusts the exposure cycle ($L_{sync}$) according to the following Formula #1.

$$L_{sync}\text{ (adjusted value)}=L_{sync}\text{ (initial value)}\times(t/tstd) \qquad \text{Formula \#1}$$

Herein, the $L_{sync}$ (initial value) is an initial value of the exposure cycle ($L_{sync}$) of the LED head 23. The LED head 23 subjecting to the adjustment of the exposure cycle ($L_{sync}$) is the LED head 23 of the ID units 24 other than the ID unit 24K on the most downstream side as the standard, or namely the LED heads 23Y, 23M, 23C. With this operation, the color shifting amount of the patterns for color shifting detection of the respective colors with respect to the pattern for color shifting detection of the black color is reduced or extinguished, so that image contraction and expansion in regular image forming processes is removed.

Finally, at Step S5, the control unit 30 of the image forming apparatus 10 ends the image contraction and expansion correction.

Next, the flowchart in FIG. 3 is described. At Step S1, the control unit 30 begins the image contraction and expansion correction. Then, at Step S2, the control unit 30 calculates the color shifting amount (t) with the upstream ID unit 24 and the downstream ID unit 24 as the standard. At Step S3, the color shift sensor 11 judges as to whether $t \leq t_{std}$ or not. If it is $t \leq t_{std}$, the processing goes to Step S5, and if it is not "$t \leq t_{std}$" the processing goes to Step S4. At Step S4, the LED head controller 36 adjusts the exposure cycle ($L_{sync}$) of the LED head 23. At Step S5, the control unit 30 ends the image contraction and expansion correction.

Thus, with this embodiment, in a case where there is no positional shift of the formation of the toner images at the ID units 24 occurring due to e.g., size deviation and aging changes of various members, or in other words, where the color shifting is caused mainly from image contraction and expansion occurring due to speed deviations of the intermediate transfer belt 13, the color shifting amount (t) is calculated with the ID unit 24Y located on the most upstream side in the conveyance direction of the intermediate transfer belt 13 and the ID unit 24K forming black toner images as the standard color located on the most downstream side in the conveyance direction of the intermediate transfer belt 13, thereby adjusting the exposure cycle ($L_{sync}$) of the LED heads 23 equipped at the ID units 24 other than the ID unit 24 as the standard without multiplying $t/t_{std}$. With this operation, without changing any structure of the image forming apparatus 10, as well as without increasing any cost, the toner consumption can be suppressed, and the image contraction and expansion occurring due to deviations of the conveyance speed of the intermediate transfer belt 13 can be prevented.

Second Embodiment

A second embodiment of the invention is described. Parts or members having the same structure as those in the first embodiment are omitted from the description in providing the same reference numbers. Substantially the same operations and advantages as those in the first embodiment are also omitted from the description.

Figure 4:
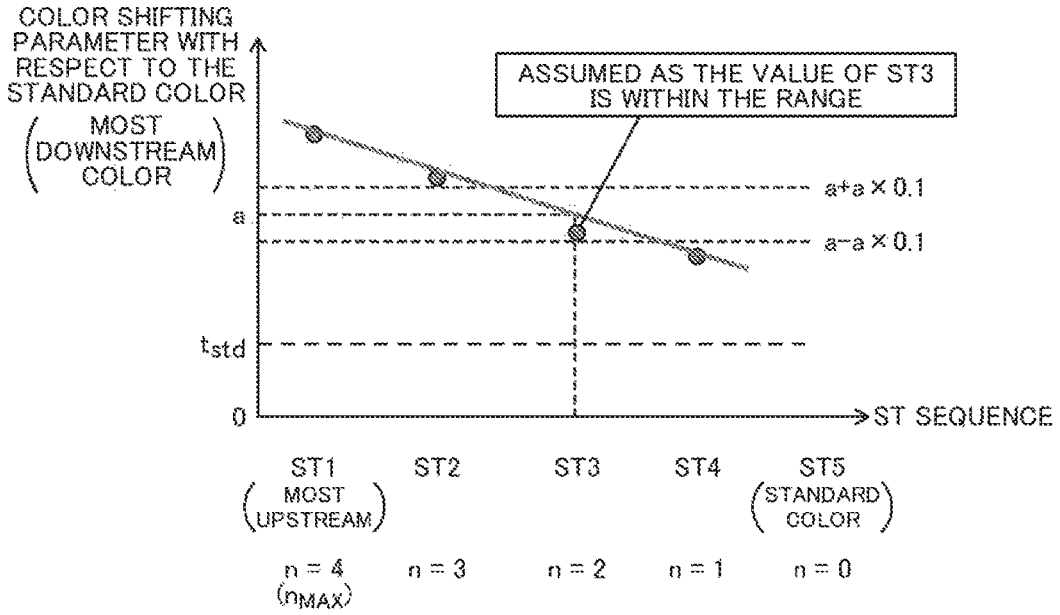
FIG. 4 is a first diagram showing a relation between the position of an ID unit and a color shifting amount according to the second embodiment of the invention.
Figure 5:
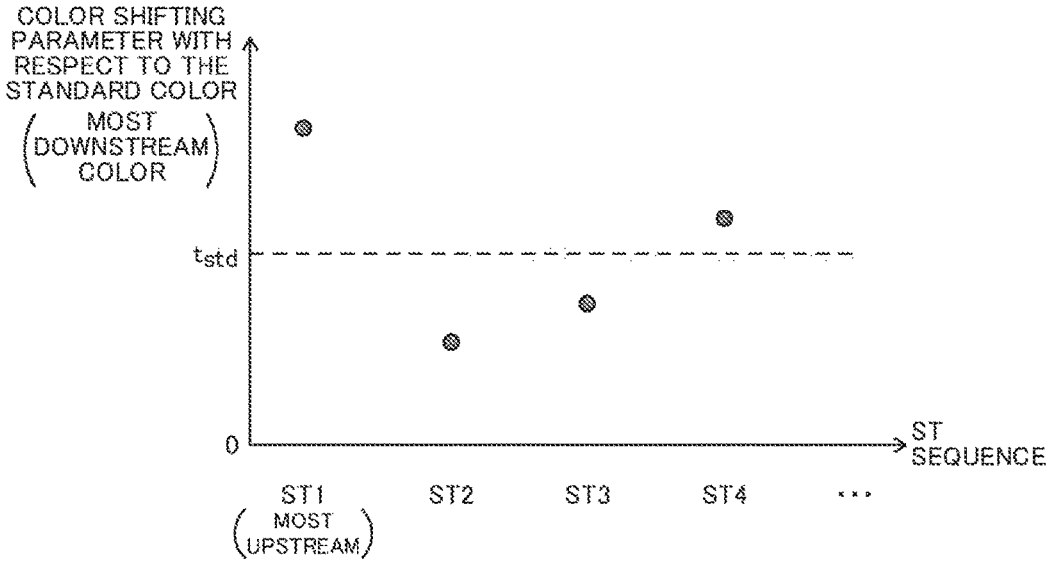
FIG. 5 is a second diagram showing a relation between the position of an ID unit and a color shifting amount according to the second embodiment of the invention.
Figure 6:
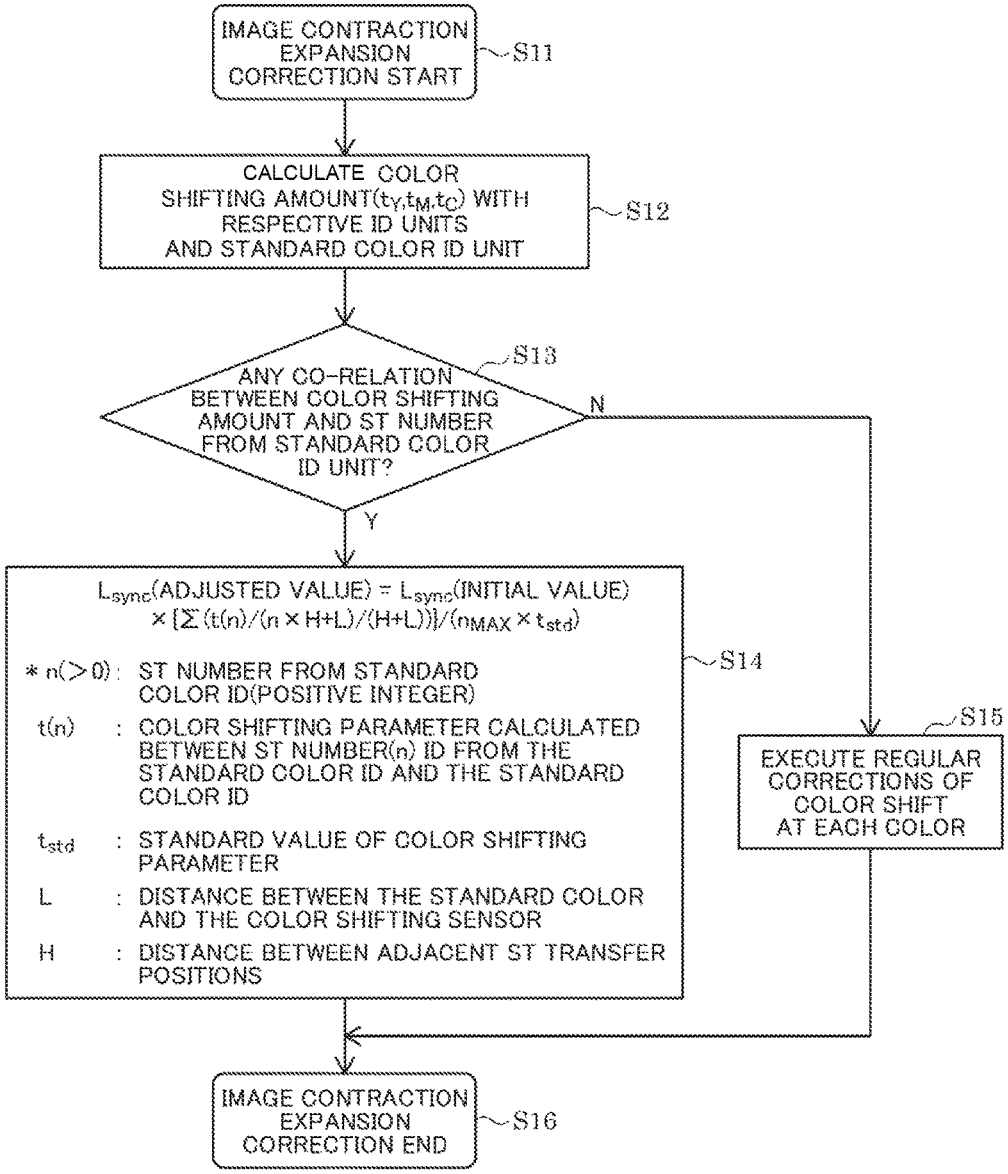
FIG. 6 is a flowchart showing operation of an image contraction and expansion control according to the second embodiment of the invention.

FIG. 4 is a first diagram showing a relation between the position of an ID unit and a color shifting amount according to the second embodiment of the invention; FIG. 5 is a second diagram showing a relation between the position of an ID unit and a color shifting amount according to the second embodiment of the invention; and FIG. 6 is a flowchart showing operation of an image contraction and expansion control according to the second embodiment of the invention.

In this embodiment, operation for correcting image contraction and expansion is described where the main cause of the color shifting of the toner images is not apparent as to whether it is from image contraction and expansion occurring due to speed deviations of the intermediate transfer belt 13 or from the positional shift of the formation of the toner images at the ID units 24 occurring due to e.g., size deviation and aging changes of various members. The structure of the image forming apparatus 10 is substantially the same as that in the first embodiment, so that detailed description is omitted.

At Step S11, the image forming apparatus 10 begins control operation for correcting image contraction and expansion, that is, correction of image contraction and expansion. More specifically, the control unit 30 begins image contraction and expansion correction at a time, e.g., when executing an initial processing where the image forming apparatus 10 is powered on, and when finishing printing jobs of a prescribed number.

Subsequently, at Step S12, the image forming apparatus 10 calculates the color shifting amounts ($t_Y$, $t_M$, $t_C$) among the respective ID units 24 and the ID unit 24K as the standard color. More specifically, the control unit 30 renders the ID units 24Y, 24M, 24C and the ID unit 24K forming black toner images as the standard color located on the most downstream side in the conveyance direction of the intermediate transfer belt 13 form yellow, magenta, and cyan patterns for detecting color shifting as well as a black pattern for detecting color shift, respectively, to be transferred to the intermediate transfer belt 13. The color shift sensor 11 detects the yellow, magenta, cyan, and black patterns for detecting color shifting transferred to the intermediate transfer belt 13, and calculates the color shifting amount ($t_Y$), the color shifting amount ($t_M$), and the color shifting amount ($t_C$) in relation to the conveyance direction of the intermediate transfer belt 13. The color shifting amount ($t_Y$), the color shifting amount ($t_M$), and the color shifting amount ($t_C$) are parameters indicating the color shifting amounts of the yellow, magenta, and cyan patterns for color shifting detection with respect to the black pattern for color shifting detection where rendering the black pattern for color shifting detection set as the standard. Specific calculation methods of the color shifting amount ($t_Y$), the color shifting amount ($t_M$), and the color shifting amount ($t_C$) are disclosed in, e.g., Japanese Patent Application Publication (A1), No. 2001-134041, above-mentioned, and any duplicated description is omitted.

Subsequently, at Step S13, the image forming apparatus 10 judges as to whether there is any correlative relation between the color shifting amount and the ST number from the standard color ID unit 24. More specifically, the control unit 30 judges as to whether there is any correlative relation between the color shifting amount ($t_Y$), the color shifting amount ($t_M$), and the color shifting amount ($t_C$) calculated at Step S12 and the ST number from the standard color ID unit 24.

The standard color ID unit 24 is the ID unit 24K as the standard, whereas the ST number is the number of the ID units 24. For example, in a case of the ID unit 24 adjacent to the ID unit 24K, the ST number from the standard color ID unit 24 is one; in a case of the ID unit 24 located at the second next from the ID unit 24K, the ST number from the standard color ID unit 24 is two; in a case of the ID unit located at the N-th next from the ID unit 24K, the ST number from the standard color ID unit 24 is N. The correlative relation is a linear relation.

That is, the control unit 30 judges as to whether the color shifting amounts (t) of the respective ID units 24 are in a relation increasing or decreasing linearly as the ID unit 24 is positioned more remote from the ID unit 24K as the standard color ID unit 24.

More specifically, the control unit 30 judges as the correlative relation exists in a case that the relation between the color shifting amount (t) of the respective ID units 24 and the ST numbers of the standard color ID unit 24 is as shown in FIG. 4, and the processing goes to Step S14. If the correlative relation exits, it is assumed that main causes of the color shifting of the toner images are image contraction and expansion occurring due to speed deviations of the intermediate transfer belt 13, and at Step S14 where the main causes of the color shifting of the toner images are image contraction and expansion occurring due to speed deviations of the intermediate transfer belt 13, operation for correcting the image contraction and expansion is executed. The control unit 30 judges as the correlative relation does not exist in a case that the relation between the color shifting amount (t) of the respective ID units 24 and the ST numbers of the standard color ID unit 24 is not as shown in FIG. 4, or namely that the relation is as shown in FIG. 5, and the processing goes to Step S15. Where the correlative relation does not exist, it is assumed that the main causes of the color shifting of the toner images are positional shift of the formation of the toner images at the respective ID units 24 occurring due to e.g., size deviation and aging changes of various members, and at Step S15, operation for correcting the color shifting is done where the main causes of the color shifting of the toner images are positional shift of the formation of the toner images at the respective ID units 24 occurring due to e.g., size deviation and aging changes of various members.

FIG. 4 and FIG. 5 are graphs showing results that the inventor of this invention actually measured relations between the color shifting amounts (t) of the respective ID units 24 and the ST numbers from the standard color ID unit 24 in use of a five color LED printer C941 (product name) sold by Oki Data Corporation. In FIG. 4 and FIG. 5, the vertical axis indicates color shifting amounts as the color shifting parameters of the patterns for detecting color shifting of the respective ID units 24 with respect to the black pattern for detecting color shifting as the standard color, whereas the horizontal axis indicates the respective station numbers (ST numbers) of the respective ID units 24 as ST1 to ST5, and the dots (black circles) indicate the measured color shifting amounts of the respective ID units 24. Value $t_{std}$ is a standard value of the color shifting amounts as the color shifting parameters where the image contraction and expansion occurring due to speed deviations of the intermediate transfer belt 13 is the main cause of the color shifting of the toner images, and is substantially the same value of the threshold value ($t_{std}$) for discriminating existence of color shifting as described in the first embodiment.

It is to be noted that in FIG. 4 and FIG. 5, the station number of the ID unit 24 located on the most upstream side in the conveyance direction of the intermediate transfer belt 13 is ST1. The number increases as moving toward the downstream side in the conveyance direction of the intermediate transfer belt 13, and the station number of the station of the ID unit 24 serving as the standard located at the most downstream side is ST5. It is to be noted that FIG. 4 and FIG. 5 are for the situation of the five color LED printer "C941" as described above, so that the station number is up to five, whereas the station number is up to four in a case of the four color printer shown in FIG. 1 as described in the first embodiment.

In the example shown in FIG. 4, each dot can be said as in-line, and it turns out that the relation between the color shifting amounts (t) of the respective ID units 24 and the ST numbers from the standard color ID unit 24 is linear. It is to be noted that the straight line shown in FIG. 4 is an approximate straight line approximating a dot profile obtained from connecting the dot corresponding to ST1 with the dot corresponding to ST4, but it may be an approximated straight line obtained in use of the least squares method.

With the example shown in FIG. 4, the dot indicating the color shifting amount of ST3 is most remote from the approximated straight line. Accordingly, it can be said that the dot is also satisfy the correlative relation indicated with the approximated straight line, because the value of the color shifting amount indicated by the dot is within plus and minus 10% of the value (a) of the color shifting amount of ST3 shown by the approximated straight line serving as an interpolation line given from other color shifting amounts, or namely in a range of a±0.1a. That is, the control unit 30 judges that there is the correlative relation between the values of the color shifting amounts of the respective ID units 24 and the ST numbers from the standard color ID unit 24 if the values of the color shifting amounts of the respective ID units 24 are within a range of plus and minus 10% in the vertical direction of the approximated straight line, and otherwise judges no correlative relation.

With the example shown in FIG. 5, the respective dots cannot be said mostly as in-line, and it is apparent that no correlative relation exists between the values of the color shifting amounts (t) of the respective ID units 24 and the ST numbers from the standard color ID unit 24. Accordingly, the control unit 30 judges that no correlative relation exists in a case that the relation between the color shifting amounts (t) of the respective ID units 24 and the ST numbers from the standard color ID unit 24 is a shown in FIG. 5.

At Step S14, the image forming apparatus 10 adjust the exposure cycle ($L_{sync}$) of the LED heads 23. More specifically, the LED head controller 36 adjust the exposure cycle ($L_{sync}$) according to the following Formula #2.

$$L_{sync}\text{ (adjusted value)}=L_{sync}\text{ (initial value)}\times[\Sigma(t(n)/(n\times H+L)/(H+L))]/(n_{max}\times t_{std}) \quad \text{Formula \#2}$$

Herein, the symbol n is a natural number and the ST number from the standard color ID unit 24. The symbol $n_{max}$ is the maximum value of n. The symbol t(n) is a parameter indicating the color shifting amount of the pattern for detecting color shift formed by the ID unit 24 having the ST number of n from the standard color ID unit 24, with respect to the pattern for detecting color shifting formed by the standard color ID unit 24. The symbol $t_{std}$ is a standard value of the parameter indicating the color shifting amount in a case that image contraction and expansion occurring due to speed deviations of the intermediate transfer belt 13 is the main cause of the color shifting of the toner images. The symbol L is a conveyance distance of the intermediate transfer belt 13 from the transfer position of the standard color (black), or namely the primary transfer roller 12K, to the color shift sensor 11. The symbol H is a conveyance distance of the intermediate transfer belt 13 between the transfer positions of the ID units 24 adjacent to each other, or namely between the primary transfer rollers 12. It is to be noted that the LED head 23 as the target of the exposure cycle ($L_{sync}$) adjustment is the LED heads 23 of the ID units 24 other than the ID unit 24K on the most downstream side as the standard, or namely the LED heads 23Y, 23M, 23C. The control unit 30 may make a feedback control to the exposure cycle of the LED head 23 toward reducing the color shifting amount. With this operation, the color shifting amount of the patterns for color shifting detection of the respective colors with respect to the pattern for color shifting detection of the black color is reduced or extinguished, so that image contraction and expansion in regular image forming processes is removed.

At Step S15, the image forming apparatus 10 executes the regular color shifting correction at each color. More specifically, the control unit 30 performs operation correcting color shifting in a case that the main causes of the color shifting of the toner images are positional shifts of the formation of the toner images in the respective ID units 24 occurring due to, e.g., size deviations or aging changes of the various members. The correction method is substantially the same as that is disclosed in e.g., Japanese Patent Application Publication (A1), No. 2001-134041, above-mentioned, and any duplicated description is omitted.

Finally, at Step S16, the control unit 30 of the image forming apparatus 10 ends the image contraction and expansion.

Next, the flowchart in FIG. 6 is described. At Step S11, the control unit 30 begins the image contraction and expansion correction. Then, at Step S12, the control unit 30 calculates the color shifting amounts ($t_Y$, $t_M$, $t_C$) with the ID units 24 and the standard color ID unit 24K. At Step S13, the control unit 30 judges as to whether any correlative relation exists between the color shifting amounts and the ST numbers from the standard color ID unit 24. If there is the correlative relation, the processing goes to Step S14, and if no correlative relation exists, the processing goes to Step S15. At Step S14, the LED head controller 36 adjusts the exposure cycle ($L_{sync}$) of the LED head 23. At Step S15, the control unit 30 executes the regular color shifting correction at each color. At Step S16, the control unit 30 ends the image contraction and expansion correction.

Thus, in the second embodiment, the color shifting amounts ($t_Y$, $t_M$, $t_C$) are calculated with the respective ID units 24 and with the ID unit 24 as the standard located on the most downstream side in the conveyance direction of the intermediate transfer belt 13; the main causes of the color shifting of the toner images are judged as to whether from the image contraction and expansion occurring due to speed deviations of the intermediate transfer belt 13 or from positional shifts of the formation of the toner images at the respective ID units occurring due to, e.g., size deviations or aging changes of the various members. With this operation, proper correction according to the causes can be performed.

It is to be noted that in the first and second embodiments, the image forming apparatus 10 is exemplified as a printer of the intermediate transfer type, but is applicable to such as, e.g., printers of a direct transfer type, facsimile machines, photocopiers, and MPFs.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming apparatus comprising:

a first image forming unit for forming toner images on a first photosensitive body;

a second image forming unit for forming toner images on a second photosensitive body;

a first exposure unit for exposing the first photosensitive body;

a second exposure unit for exposing the second photosensitive body;

a transfer unit for transferring, onto an intermediate transfer belt, toner images for correction formed by the first image forming unit and the second image forming unit;

a detection unit for detecting the toner images for correction; and a control unit for controlling an exposure cycle of the first exposure unit, wherein the control unit corrects the exposure cycle of the first exposure unit based on a detected consequence of the detection unit, wherein the detection unit detects a shifting amount of the toner image for correction formed by the first image forming unit with respect to the toner image for correction formed by the second image forming unit, and wherein the control unit corrects the exposure cycle of the first exposure unit where the shifting amount exceeds a preset threshold value, and wherein the control unit corrects the exposure cycle of the first exposure unit by multiplying a value of the shifting amount divided by the threshold value by an initial value of the exposure cycle of the first exposure unit.

2. The image forming apparatus according to claim 1, wherein the second image forming unit is disposed on a most downstream side in a conveyance direction of the intermediate transfer belt whereas the first image forming unit is disposed on an upstream side of the second image forming unit in the conveyance direction of the intermediate transfer belt.

3. The image forming apparatus according to claim 1, further comprising a third image forming unit disposed between the first image forming unit and the second image forming unit in a conveyance direction of the intermediate transfer belt for forming toner images on a third photosensitive body, and a third exposure unit for exposing the third photosensitive body, wherein the control unit corrects the exposure cycle of the third exposure unit based on the detected consequence of the detection unit.

4. The image forming apparatus according to claim 1, wherein the control unit makes a feedback control to the exposure cycle of the first exposure unit toward reducing the shifting amount.

5. An image forming apparatus comprising:

a first image forming unit for forming toner images on a first photosensitive body;

a second image forming unit for forming toner images on a second photosensitive body;

a first exposure unit for exposing the first photosensitive body;

a second exposure unit for exposing the second photosensitive body;

a transfer unit for transferring, onto an intermediate transfer belt, toner images for correction formed by the first image forming unit and the second image forming unit;

a detection unit for detecting the toner images for correction; and a control unit for controlling an exposure cycle of the first exposure unit, wherein the control unit corrects the exposure cycle of the first exposure unit based on a detected consequence of the detection unit, and wherein the detection unit detects a shifting amount of the toner image for correction formed by the first image forming unit with respect to the toner image for correction formed by the second image forming unit, and wherein the control unit corrects the exposure cycle of the first exposure unit where a correlative relation exists between the shifting amount and an image forming unit number (ST number) given from the second image forming unit.

6. The image forming apparatus according to claim 5, wherein the second image forming unit is disposed on a most downstream side in a conveyance direction of the intermediate transfer belt whereas the first image forming unit is disposed on an upstream side of the second image forming unit in the conveyance direction of the intermediate transfer belt.

7. The image forming apparatus according to claim 5, wherein the correlative relation is a linear relation between the shifting amount and the image forming unit number (ST number) given from the second image forming unit.

8. The image forming apparatus according to claim 7, wherein the linear relation is assumed where one color shifting amount is plotted within plus and minus 10% from an amount existing on an interpolation line given from other color shifting amounts.

9. The image forming apparatus according to claim 5, further comprising a third image forming unit disposed between the first image forming unit and the second image forming unit in a conveyance direction of the intermediate transfer belt for forming toner images on a third photosensitive body, and a third exposure unit for exposing the third photosensitive body, wherein the control unit corrects the exposure cycle of the third exposure unit based on the detected consequence of the detection unit.

10. The image forming apparatus according to claim 5, wherein the control unit makes a feedback control to the exposure cycle of the first exposure unit toward reducing the shifting amount.

* * * * *